United States Patent [19]

Herr et al.

[11] 4,301,978

[45] Nov. 24, 1981

[54] ELECTRO-MAGNETIC THREAD TENSION CONTROL FOR SEWING MACHINES

[75] Inventors: John A. Herr, Garwood; Wolfgang Jaffe, Roselle Park, both of N.J.

[73] Assignee: The Singer Company, Stamford, Conn.

[21] Appl. No.: 27,412

[22] Filed: Apr. 5, 1979

[51] Int. Cl.[3] ..... D05B 47/00; D05B 47/04; B65H 59/22

[52] U.S. Cl. ..... 242/150 R; 112/254

[58] Field of Search ..... 112/255, 254; 242/150 R, 155 M, 156, 147 M, 150 M; 335/234, 261, 262; 66/146

[56] References Cited

U.S. PATENT DOCUMENTS

| | | | |
|---|---|---|---|
| 2,698,590 | 1/1955 | Garbe | 112/254 |
| 2,907,535 | 10/1959 | Mindheim et al. | 242/150 |
| 3,001,946 | 9/1961 | Jentschmann | 242/150 |
| 3,100,091 | 8/1963 | Mindheim et al. | 242/150 |
| 3,231,216 | 1/1966 | Lemarchand | 242/150 |
| 3,533,574 | 10/1970 | Cooper et al. | 242/150 R |
| 3,724,409 | 4/1973 | Olney | 112/255 |
| 3,797,426 | 3/1974 | VonHagen | 112/254 |
| 3,827,382 | 8/1974 | DeVita et al. | 112/255 |
| 3,877,405 | 4/1975 | Dorosz et al. | 112/255 |
| 3,987,385 | 10/1976 | Diller et al. | 335/261 X |
| 3,991,954 | 11/1976 | Schwartz | 66/146 |
| 4,065,739 | 12/1977 | Jaffe et al. | 335/261 |

FOREIGN PATENT DOCUMENTS 2809848 3/1978 Fed. Rep. of Germany .

*Primary Examiner*—Werner H. Schroeder
*Assistant Examiner*—Andrew M. Falik
*Attorney, Agent, or Firm*—Edward P. Schmidt; Robert E. Smith; Edward L. Bell

[57] ABSTRACT

A tension device for sewing machines is disclosed having thread tensioning discs and a linear actuator for applying a compressive force between the discs. The invention is characterized in that for any given tension setting of the device, the applied compressive force, or tension, remains constant regardless of any variations in the spacing of the discs due to variations in the thread thickness, up to the range of travel of the linear actuator.

1 Claim, 7 Drawing Figures

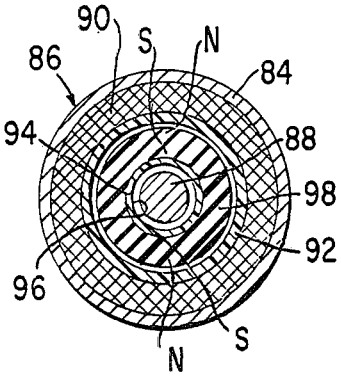
Fig. 4
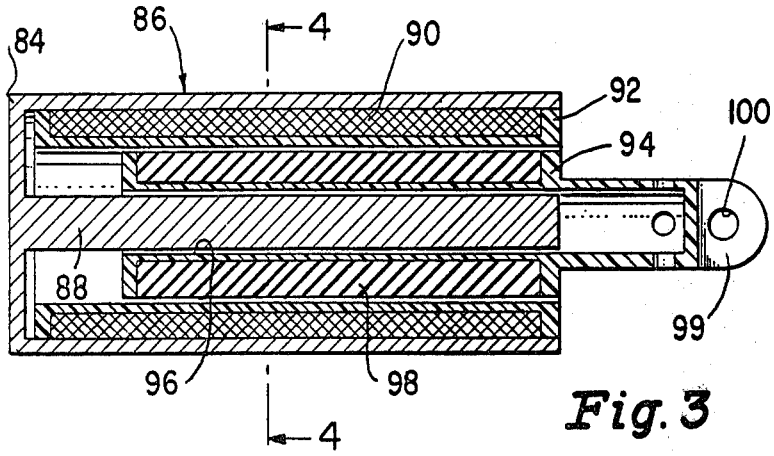
Fig. 3
Fig. 6
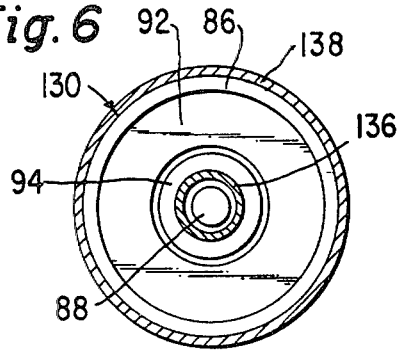
Fig. 5
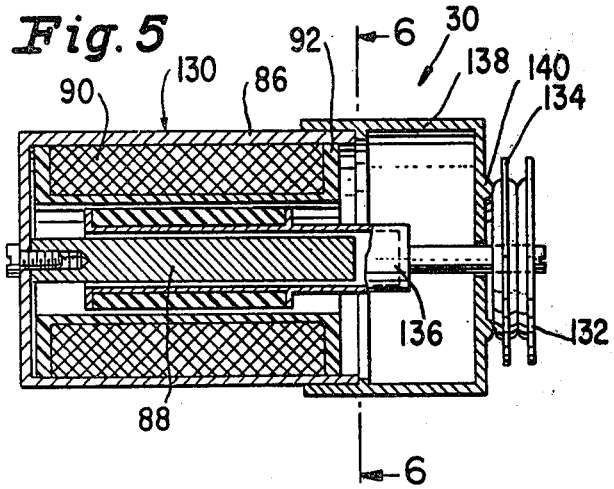
Fig. 7
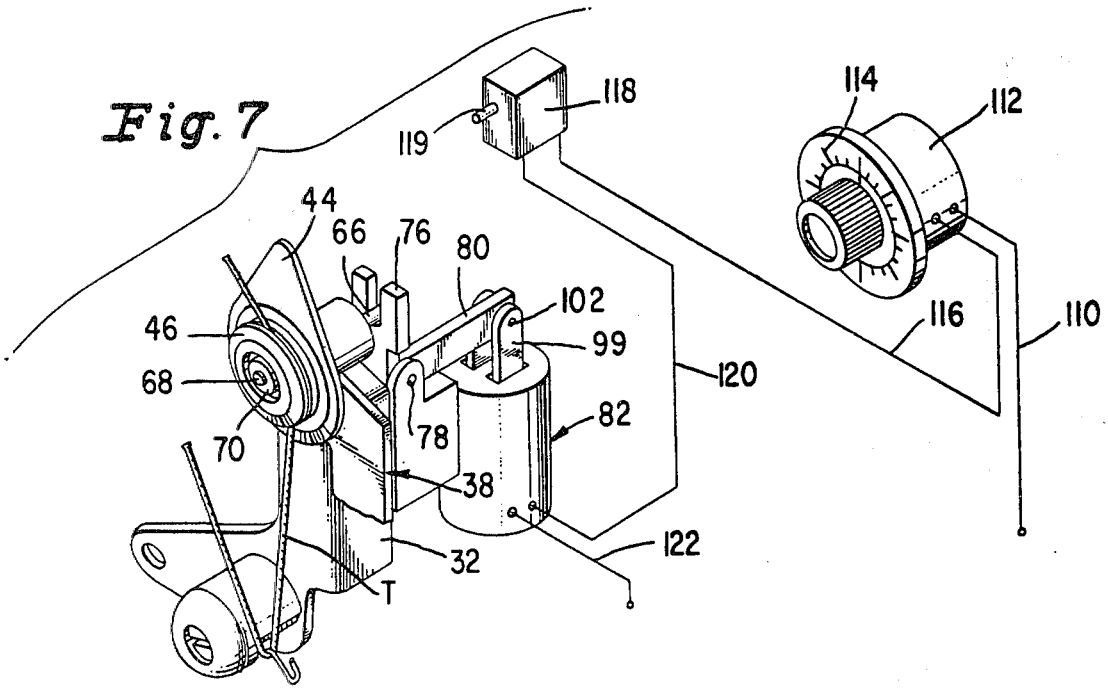

ELECTRO-MAGNETIC THREAD TENSION CONTROL FOR SEWING MACHINES

BACKGROUND OF THE INVENTION

The thread tension device on a sewing machine is intended to apply a prescribed amount of "drag" on the sewing thread to enable the sewing machine to properly set a stitch. Depending upon the type and thickness of the material being sewn, as well as the type and thickness of the thread, the drag, or tension setting, is varied such that an optimum stitch may be obtained. Ordinarily, thread tension devices use a spring for applying a compressive force to a set of tension discs between which the thread is passed. A screw arrangement is used to vary the compression on the spring thereby varying the tension on the thread. If the thread passing between the discs is uniform, this arrangement will supply a constant uniform tension to the thread. However, in actuality, the thread is not uniform and there are variations in the thickness thereof. This causes the tension discs to separate increasing the compression on the spring which, in turn, exerts a greater compressive force on the thread. This varying tension may result in improperly set stitches and even possible breakage of the thread itself.

SUMMARY OF THE INVENTION

The object of this invention is to provide a tension device for a sewing machine capable of exerting uniform tension on a thread regardless of variations in the thickness thereof. This object is achieved in a tension device having a set of thread tensioning discs, between which the thread passes by applying a uniform compressive force on the tension discs independent of the spacing therebetween by means of an electro-magnetic actuator which develops a uniform force in response to any given level of electrical current input.

DESCRIPTION OF THE DRAWINGS

With the above and additional objects and advantages in mind as will hereinafter appear, the invention will be described with reference to the attached drawings in which:

FIG. 3 is a lengthwise cross-sectional view of the linear actuator of this invention;

FIG. 4 is a cross-sectional view of the linear actuator taken along the line of 4—4 of FIG. 3;

FIG. 5 is a lengthwise cross-sectional view of a linear actuator in a second embodiment of this invention, FIG. 6 is a cross-sectional view of the linear actuator taken along the line 6—6 of FIG. 5; and FIG. 7 is a perspective view of the first embodiment of this invention diagrammatically showing the electrical circuit.

DESCRIPTION OF THE PREFERRED EMBODIMENT

Figure 1:
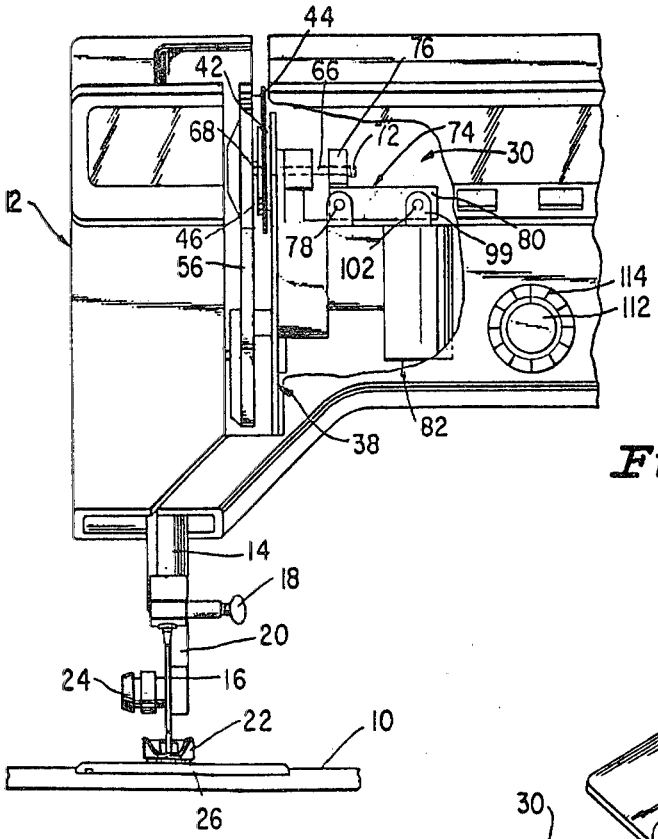
FIG. 1 is a front elevational view of the head of a sewing machine, partly in section, showing the invention incorporated therein.

In FIG. 1 a sewing machine is shown as having a bed 10 and a sewing head 12. A needle bar 14 is carried within the sewing head 12 and is arranged for reciprocatory motion. A sewing needle 16 is removably attached to the exposed end of the needle bar 14 by means of a screw clamp 18. Also carried in the sewing head 12 is a downwardly biased presser bar 20 having a presser foot 22 removably attached thereto by a screw clamp 24. The presser foot 22, under the influence of the downward bias on the presser bar 20, urges the material being sewn into engagement with a feed mechanism characterized by a feed dog 26 located in the bed 10 of the sewing machine.

Figure 2:
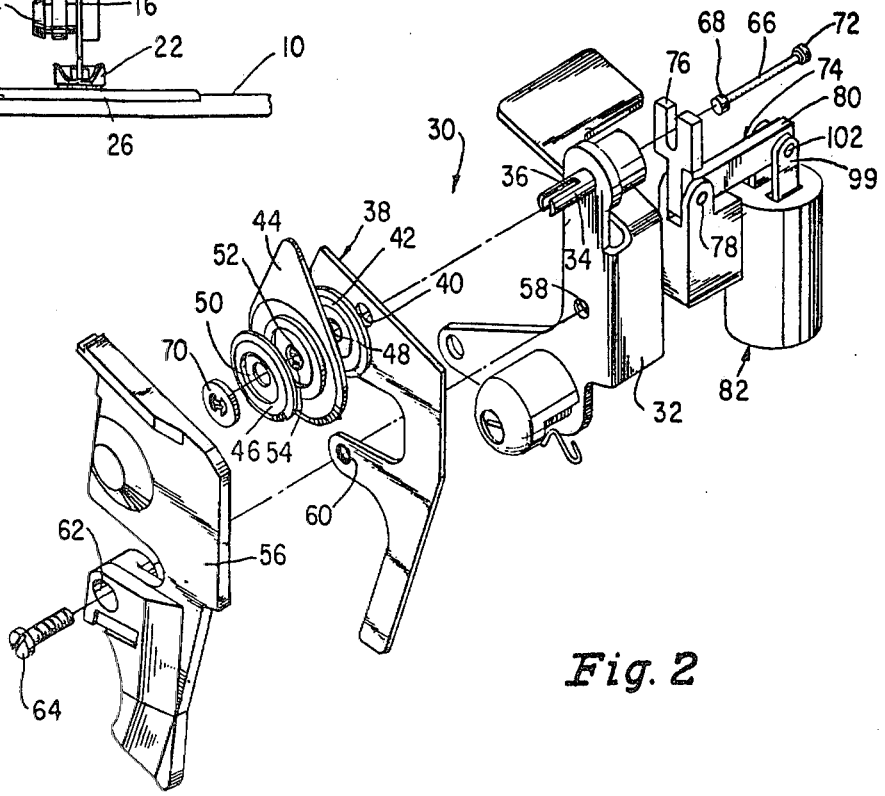
FIG. 2 is an exploded perspective view of the tension device of this invention.

In order for the sewing machine to properly make a stitch, a certain amount of drag, or tension, must be applied to a sewing thread T. To this end, the tension device 30 of this invention may be found within the sewing head 12. The tension device 30 as shown and described herein has two thread paths such that it may be used to tension two sewing threads simultaneously. However, a single thread may also be used effectively with the device for which the following discussion will pertain. The tension device 30 as shown in FIG. 2 includes a frame 32 having a hollow tube 34, with a longitudinal split 36 therein, depending from the frame 32. A first thread guiding plate 38 is formed with a hole 40 therein for slidably engaging the tube 34. A set of tension discs 42, 44, and 46 are provided for engaging the sewing thread T. The tension discs 42 and 46 are identical and are each respectively formed with a circular aperture 48 and 50 therethrough for rotatably engaging the tube 34. The tension disc 44, which is located between the tension discs 42 and 46, is substantially larger than the discs 42 and 46 such that the tension disc 44 may act as a guide for thread entering between the tension disc 44 and either of the tension discs 42 or 46. An aperture 52 is formed in the tension disc 44 for slidably engaging the tube 34. Tabs 54 extend from the tension disc 44 into the aperture 52 and engage the slot 36 in the tube 34 preventing the tension disc 44 from rotating. A second thread guiding plate 56 is provided for guiding the thread from the tension discs 42, 44 and 46 to other thread manipulating instrumentalities with which the present invention is not concerned, such as a check spring, thread takeup (none of which are shown). Clearance holes 58, 60 and 62 are formed respectively in the frame 32, the first thread guiding plate 38 and the second thread guiding plate 56 through which a screw 64 passes for mounting the tension device 30 in the sewing head 12.

In order to apply a compressive force to the tension discs 42, 44, 46, a pin 66 is provided for passing through the tube 34. The pin 66 is formed with a first shoulder 68 at one end thereof for engaging a retaining disc 70 which, in turn, bears against the tension discs 42, 44 and 46. The opposite end of the pin 66 extends outside the frame 32 and is formed with a second shoulder 72 which is engaged by a bell crank 74 having a first arm 76 bifurcated for embracing the pin 66 and abutting the second shoulder 72. The bell crank 74 is pivotally mounted on a pin 78 and includes a second arm 80 which is pivotally engaged by a linear actuator 82.

The linear actuator 82, as shown in FIGS. 3 and 4, includes a base 84, a cylindrical frame 86 extending from the base 84, and a guide stud 88 also extending from the base 84, coaxial with the frame 86. The base 84, the frame 86 and the stud 88 are all made of a magnetic material. An electrical coil 90, wrapped around a non-magnetic spool 92, is mounted to the inner periphery of the frame 86. The remaining space between the spool 92 and the stud 88 is occupied by a cylindrical armature 94 having a central bore 96 for slidably engaging the stud 88. In accordance with the teachings in U.S. Pat. No. 4,065,739 of Jaffe, et al, a flexible magnet 98, having previously been magnetized, is wrapped around the outside of the armature 94 and is secured thereto as by an adhesive or the like. In order for the electro-magnetic actuator 82 to output a uniform force in response to any given level of electrical current input to the electrical coil 90, the over all length of the flexible magnet 98, when installed on the armature 94, should be less than the length of the electrical coil 90; the difference in the lengths of the parts 90 and 94 establishing the range of movement of the armature 94 in response to energization of the coil 90 over which a constant force will be exerted thereon. The magnet 98 should be arranged adjacent to the electrical coil in all positions within the range of movement; and both the electrical coil 90 and the armature 94 should be electrically and magnetically uniform throughout their entire lengths. The exposed end 99 of the armature 94 is bifurcated for embracing the second arm 80 of the bell crank 74. Clearance holes 100 are formed through both the bifurcated end 99 of the armature 94 and the bell crank 74 second arm 80 through which a pivot pin 102 is passed.

FIG. 7 shows a sample electrical circuit for energizing the linear actuator 82. Electrical power is provided by a regulated voltage supply (not shown) and travels along a wire 110 to a variable current control 112, such as a potentiometer, mounted on the sewing head 12, accessible to the operator. The control 112 has indicia 114 thereon relating to the amount of tension being applied to the thread. A wire 116 connects the current control 112 to a tension release switch 118 including a switch opening element 119 preferably located in the path of the presser bar or in the path of an element carried on the presser bar which opens the circuit thereby releasing the tension whenever the presser bar 20 is lifted. A wire 120 connects the switch 118 to the linear actuator 82. A wire 122 then connects the actuator 82 back to the voltage supply.

In operation, the regulated voltage supply is activated and the operator sets the desired tension by operating the variable current control 112. After the operator threads the sewing machine, that is, passes thread T from a thread supply over the first thread guide 38, between the tension discs 44 and 42 or 46, around the second thread guide 56 and onto the sewing needle 16, when the operator lowers the presser bar 20 causing the presser foot 22 to engage the material that is to be sewn, the switch 118 closes allowing the linear actuator 82 to be energized. Depending upon the setting of the current control 112, the actuator 82 exerts a prescribed downward force on the bell crank 74 second arm 80, causing the bell crank 74 to pivot about the pin 78. The pivoting of the bell crank 74 causes the first arm 76 thereof to pull against the second shoulder 72 of the pin 66, forcing the retaining disc 70, abutting the first shoulder 68 of the pin 66, to bear against the tension discs 42, 44 and 46, thereby applying tension to the thread therebetween. If the thickness of the thread T changes, the spacing between the applicable discs 42 and 44 or 44 and 46 changes accordingly while the linear actuator 82 exerts the same amount of force thereon. Depending upon the ratio of the length of the first arm 76 to the second arm 80 of the bell crank 74, the force exerted by the actuator 82 may be multiplied, thereby minimizing the size of the actuator 82 which would be required.

In FIGS. 5 and 6, there is shown an alternate construction of the tension device 30 wherein a linear actuator 130 acts directly upon a set of tension discs 132 and 134. The tension disc 132 is mounted to the end of the actuator 130 armature 136, while a tension disc 134 is slidably mounted thereon. The actuator 130, which is basically identical to the actuator 82, includes an end cap 138 having a thread bearing surface 140 formed thereon. The thread bearing surface 140 on the end cap 138 is shaped complimentary to the tension disc 134 and, in operation, the action of the armature 136 forces the tension disc 132 to move the disc 134 into engagement with the surface 140.

In FIG. 7 the electrical circuit includes two different control elements: the switch 118 adapted to effect control of the tension in response to a particular operation of an instrumentality of the sewing machine; and a manual control 112. It will appreciated that other control arrangements responsive, for instance, to data stored in an electronic memory could also be used with the device of this invention to provide for automatic tension control.

Numerous alterations of the structure herein disclosed will suggest themselves to those skilled in the art. However, it is to be understood that the present disclosure relates to a preferred embodiment of the invention which is for purposes of illustration only and not to be construed as a limitation of the invention. All such modifications which do not depart from the spirit and scope of the invention are intended to be included within the appended claims.

We claim:

1. A thread tension device for sewing machines comprising a pair of thread engaging elements supported for movement toward and away from each other to accommodate therebetween thread having different diameters, an electro-magnetic actuator having an electrical coil part and a ferro-magnetic armature part, means for telescopically relating said electrical coil and ferro-magnetic armature parts of said electro-magnetic actuator for lengthwise relative movement parallel to each other within a range, said parts being arranged to develop a uniform force therebetween throughout said range of relative movement in response to any given level of electrical current input to said electrical coil part, said parts being arranged to develop a uniform force therebetween by disposing said armature part within the boundaries of said electrical coil in all positions within said relative range of movement, said armature part having a dimension in the direction of said parallel movement which is smaller than that of said electrical coil part by at least the dimension of said range of movement, and in which both of said actuator parts are electrically and magnetically uniform throughout their entire length, and means for applying said uniform force developed between said electro-magnetic actuator parts to urge said thread engaging elements together.

* * * * *